US010683725B2

(12) United States Patent
Wang

(10) Patent No.: US 10,683,725 B2
(45) Date of Patent: Jun. 16, 2020

(54) METHODS AND SYSTEMS TO SEAL SUBTERRANEAN VOID

(71) Applicant: Sharp-Rock Technologies, Inc., Cypress, TX (US)

(72) Inventor: Hong Wang, Cypress, TX (US)

(73) Assignee: Sharp-Rock Technologies, Inc., Houston, TX (US)

( * ) Notice: Subject to any disclaimer, the term of this patent is extended or adjusted under 35 U.S.C. 154(b) by 0 days.

(21) Appl. No.: 15/953,002

(22) Filed: Apr. 13, 2018

(65) Prior Publication Data

US 2018/0305998 A1 Oct. 25, 2018

Related U.S. Application Data

(60) Provisional application No. 62/487,310, filed on Apr. 19, 2017.

(51) Int. Cl.
*E21B 33/13* (2006.01)
*E21B 33/138* (2006.01)
*E21B 21/00* (2006.01)

(52) U.S. Cl.
CPC ..... *E21B 33/138* (2013.01); *E21B 21/003* (2013.01)

(58) Field of Classification Search
CPC .. E21B 33/1208; E21B 33/1204; E21B 33/12; E21B 27/02; E21B 27/00
USPC ..... 166/192, 193, 194, 386, 285, 286, 292, 166/117, 153, 162, 163, 164, 165, 166, 166/167, 168, 169
See application file for complete search history.

(56) References Cited

U.S. PATENT DOCUMENTS 1,379,119 A * 5/1921 Mauzey ..... E21B 33/134 166/117
1,393,311 A * 10/1921 Pendleton ..... E21B 27/02 166/286
1,609,153 A * 11/1926 Carter ..... E21B 33/1204 166/117
1,631,419 A * 6/1927 Kinley ..... E21B 33/1204 166/117
2,768,693 A * 10/1956 Hughes, Jr. ..... E21B 33/134 166/192
3,129,762 A * 4/1964 Cooper ..... E21B 21/003 166/117
3,362,476 A * 1/1968 Van Poollen ..... C09K 8/601 166/162
5,497,829 A * 3/1996 Rajkovich ..... E21B 33/02 102/333
7,661,481 B2 * 2/2010 Todd ..... E21B 33/12 166/120
9,869,154 B2 * 1/2018 O'Malley ..... E21B 33/13
2009/0321087 A1 * 12/2009 Victorov ..... E21B 33/1204 166/386
2011/0048720 A1 * 3/2011 Diaz ..... C09K 8/518 166/309
2011/0284213 A1 * 11/2011 Willberg ..... E21B 33/1208 166/135

(Continued)

OTHER PUBLICATIONS

Merriam-Webster dictionary. "Spongy" retrieved May 17, 2019 from https://www.merriam-webster.com/dictionary/spongy (Year: 2019).*

*Primary Examiner* — Angela M DiTrani Leff
(74) *Attorney, Agent, or Firm* — Pierson IP, PLLC

(57) ABSTRACT

A device including an expandable material that is configured to be compressed in a first state while traveling through a wellbore and expanded in a second state to form a seal.

6 Claims, 3 Drawing Sheets

(56) References Cited

U.S. PATENT DOCUMENTS

2012/0285695 A1* 11/2012 Lafferty ..... C09K 8/03
166/310
2015/0275600 A1* 10/2015 Wang ..... E21B 21/066
166/267
2015/0292279 A1* 10/2015 Wang ..... C09K 8/03
166/293

* cited by examiner

METHODS AND SYSTEMS TO SEAL SUBTERRANEAN VOID

BACKGROUND INFORMATION

Field of the Disclosure

Examples of the present disclosure relate to systems and methods for sealing a subterranean void in a wellbore. More specifically, embodiments relate to a device including an expandable material that is configured to be compressed in a first state while traveling through a wellbore and expanded in a second state to form a seal.

Background

During drilling of a wellbore in a subterranean formation, drilling fluid is pumped from the surface through a drill pipe to a rotating drill bit. The fluid then goes into an annulus, between the drill pipe and the wellbore in the subterranean formation, to the surface. At the surface, the fluid may go through a solid control system and cuttings are removed. The fluid may then be recycled through fluid circulation.

In a wellbore in drilling, typically there is an upper hole section protected by a large diameter steel pipe or casing and a lower section which is simply an open hole exposed to the subterranean formation. During drilling, voids may be created in the open hole section and the drilling fluid may enter these voids, and are unable to be recaptured. Therefore it is necessary to seal the voids to stop the fluid loss. Conventionally, when the voids are smaller, sealing particles, such as calcium carbonate, is mixed in with the drilling fluids. The calcium carbonate is then positioned within the voids during circulation. For slightly larger voids, the sealing particles can be aggregated together and accumulate to form a larger seal.

Sometimes, with further larger voids even an aggregation of sealing particles is ineffective to seal the larger voids. Furthermore, larger sized sealing particles are not able to be circulated within the confines in drill pipe such as drilling tools and drill bit nozzles. Thus, to pump down larger sealing particles, conventionally a bypass tool is incorporated with the drill pipe above the drill tools and drill bit to temporarily open a large port on a side of the drill pipe, which allows for pumping of materials up to one inch.

Occasionally, the voids can be even larger than the inner diameter of drill pipe and the clearance of an annulus. The voids can even be larger than the diameter of the wellbore, which has a size typically much larger than the drill pipe or annulus. In such a case, the required sealing material to seal the voids is expected to be larger than the voids and it cannot be pumped down directly.

Accordingly, needs exist for system and methods for a device including an expandable material that is configured to be compressed in a first state while traveling through a wellbore and expanded in a second state to form a seal, wherein the expandable material breakable in the compressed and expanded states.

SUMMARY

Examples of the present disclosure relate to systems and methods for a device including an expandable material that is configured to be compressed in a first state while traveling through a wellbore and expanded in a second state to form a seal.

The device may include a container body, expandable material, and weighted end.

The container body may be substantially cylindrical in shape, wherein the container body has a smaller diameter than that of a wellbore or casing to allow the container body to pass through the wellbore. The container body may be formed of brittle or breakable materials, which may be either soft or rigid materials. For example, the container body may be formed of cloth, fabrics, polymers, or concrete, baked clay, plastics, wood, ceramics, porcelain, glass. The container body may be configured to house the expandable material and bridging material.

The container body may include a series of ports that extend through the diameter of the container body. The ports may be configured to allow drilling fluid to flow into the container and equalize pressure inside and outside of the container body. This may prevent a pressure differential inside and outside of the container body to increase to a point that would crush, break, collapse, etc. the container body.

The expandable materials may be unpumbable materials that are configured to be housed within the container body. The expandable materials may be configured to be compressed in a first state to occupy less volume, and expanded in a second state to occupy more volume. In the first state a diameter of the expandable materials may be less than that of the wellbore and in second state a diameter of the expandable materials may be greater than that of the wellbore. This may allow the expandable materials to fill voids that have a greater diameter than that of casing or wellbore. The expandable materials may have a similar density to that of the drilling fluid, and may be unpumbable materials. The expandable materials may be highly compressible and elastic such as reticulated foam, wood, plants, bricks, cotton, concrete, rubber, foam, reticulated foam, screen sheets, cloth, ropes, fibers, paper sheets, plastic film, aluminum foil, foam rubber, etc.

Sealing particles of sizes ranging from several microns to several centimeters may also be loaded into the container together with the expandable materials to further seal off the pores and gaps formed from the seal formed by the expandable materials in the voids.

The weighted end may be positioned on a distal end of the container body. The weighted end may be conical in shape. The weighted end may be formed of a rigid, high density material, such as lead, metals, etc. The weighted end may be configured to increase the bulk density and weight of the device, which may allow the device to sink into the drilling fluid within a wellbore. The weighted end may include a closed end, such that drilling fluid may not flow through the device.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
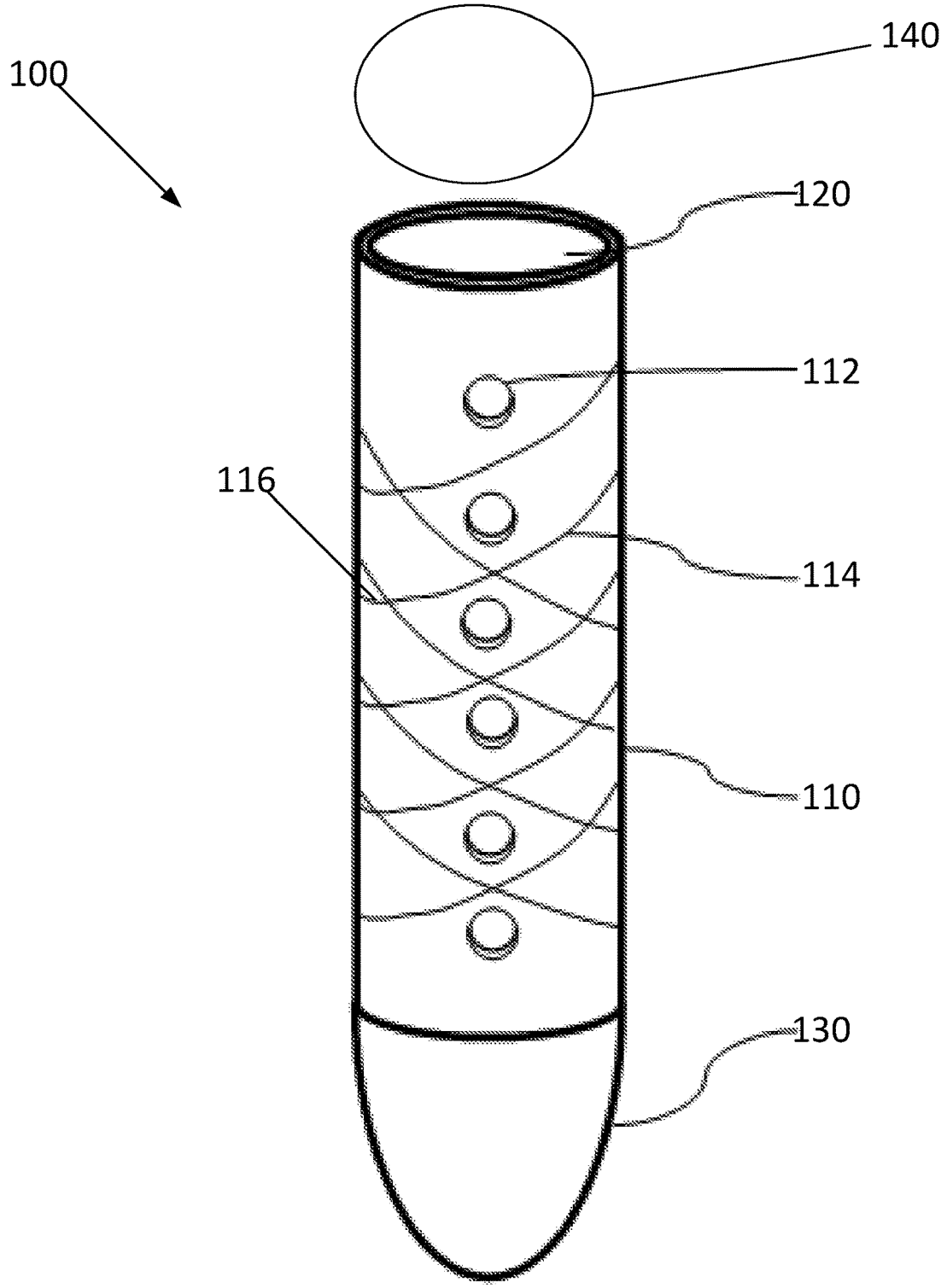
FIG. 1 depicts a device configured to seal a wellbore, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art, that the specific detail need not be employed to practice the present embodiments. In other instances, well-known materials or methods have not been described in detail in order to avoid obscuring the present embodiments.

In embodiments, the device may be positioned into a wellbore, and may drop to a bottom of the wellbore due to its weight and density. A drill pipe with a bit may be run downhole and apply force to the device, breaking the device. Expandable materials housed within the device may move from a compressed state to a non-compressed state, and may cover and seal voids within the wellbore.

FIG. 1 depicts a device 100 configured to seal a wellbore, according to an embodiment. Device 100 may be formed of breakable materials and unpumpable bridging materials that are configured to fill a void within a wellbore. Device 100 may be configured to positioned at the bottom of a wellbore, and then break when a drill bit applies pressure to device 100. The drill bit may also push the bridging materials in a direction perpendicular to the longitudinal axis of device 100 into voids within a wellbore to assist in sealing off the voids.

Device 100 may include a container body 110, expandable material 120, weighted end 130, and lid 140.

Container body 110 may be substantially cylindrical in shape, wherein the container body 110 has a smaller diameter than that of a wellbore or casing to allow container body 110 to pass through the wellbore. Container body 110 may be formed of brittle or breakable materials, which may be either soft or rigid materials, which can be broken by a drill bit. For example, container body 110 may be formed of cloth, fabrics, polymers, or concrete, baked clay, plastics, wood, ceramics, porcelain, glass. Container body 110 may be configured to house the expandable material 120 and bridging material. Container body 110 may include equalization ports 112, grooves 114, or other weak lines 116. In embodiments, container body 110 may have sidewalls that comprise heavier materials, such as barite to increase the density of container body 110. This may assist in sinking container body 110 in a wellbore. Furthermore, weighted materials such as a bag of high density barite powder may be loaded into the bottom of container body 110 to increase the weight of device 100.

Equalization ports 112 may be configured to extend through container body 110. Equalization ports 112 may be configured to allow drilling fluid to flow into container body 110 and equalize pressure inside and outside of container body 110. This may prevent a pressure differential inside and outside of container body 110 to increase to a point that would crush, break, collapse, etc. container body 110. In embodiments, equalization ports 112 may be aligned or misaligned through container body 110.

Grooves 114 may be indentations on and around an outer circumference of container body 110. Grooves 114 may reduce the thickness of areas on an outer surface of container body 110 to create break lines when force is applied to container body 110. Accordingly, grooves 114 may be utilizes to control the shaping, sizing, etc. of fragments created when container body 110 breaks. In embodiments, grooves 114 may be diagonally positioned on the outer circumference of grooves 114, where a first set of grooves are angled upward and a second set of grooves are angled downward. However, in other embodiments, grooves 114 may extend in a direction perpendicular or in parallel to the longitudinal axis of container body 110.

Expandable materials 120 may be unpumbable materials that are configured to be housed within container body 110 while travelling through the wellbores. Expandable materials 120 may be configured to be compressed in a first state to occupy less volume, and expanded in a second state to occupy more volume. In the first state, a diameter of expandable materials 120 conform to a body housing expandable materials 120, such that expandable materials 120 have substantially the same diameter of the body housing expandable materials 120. For example, in the first state, expandable materials 120 may be housed within container body 110 have a diameter that is less than that of the wellbore. In second state, a diameter of expandable materials 120 may increase to be greater than that of the wellbore, such that portions of expandable materials 120 are positioned within a void in the wellbore. This may allow expandable materials 120 to fill voids that have a greater diameter than that casing or wellbore. Expandable materials 120 may have a similar density to that of the drilling fluid, and may be unpumbable materials. The expandable materials may be bridging materials such as highly compressible and elastic reticulated foam, wood, plants, bricks, cotton, concrete, rubber, foam, reticulated foam, screen sheets, cloth, ropes, fibers, paper sheets, plastic film, aluminum foil, foam rubber, etc. In embodiments, a plurality of individual sections of expandable materials 120 may be individually pre-loaded into container body 110. This may allow different expandable materials 120 to be positioned within different voids even if the drill bit does not fracture the expandable materials.

Weighted end 130 may be positioned on a distal end of the container body 110. Weighted end 130 may be coupled to the distal end of container body 110 via a plurality of fashions, such as being screwed onto the distal end of container body 110, welded to the distal end of container body, glued to the distal end of container body 110, etc. Weighted end 130 may be conical and shape to assist the movement of device 100 through the wellbore. Weighted end 130 may be formed of a rigid, high density material, such as lead, metals, etc., which may be different than that of container body 110 and expandable materials 120. Weighted end 130 may be configured to increase the bulk density and weight of the device, which may allow the device to sink into the drilling fluid within a wellbore. Weighted end 130 end may include a closed end, such that drilling fluid may not flow through the device 100. The weight of weighted end 130 may be greater than the rest of device 100.

Lid 140 may be positioned on a proximal end of container body 110. Lid 140 may be configured to cover container body 110 to limit an amount of fluid flowing into container body 110 and to maintain the compressible materials in the compressed state. Lid 140 may be coupled to the proximal end of container body 110 via a plurality of fashions, such as being screwed onto the proximal end of container body 110, welded to the proximal end of container body, proximal to the distal end of container body 110, etc.

Figure 2:
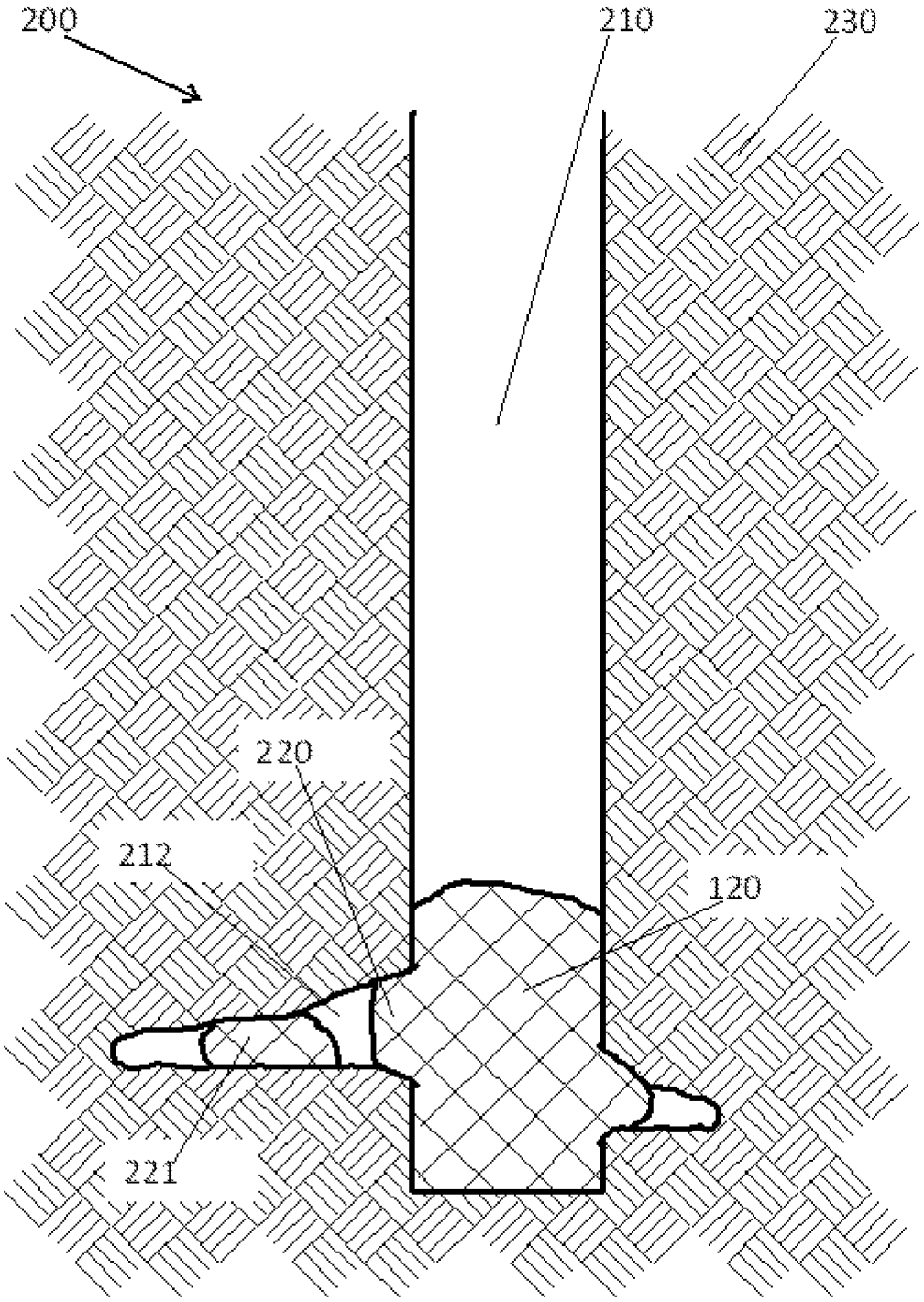
FIG. 2 depicts a wellbore with filled voids, according to an embodiment.

FIG. 2 depicts a wellbore system 200 with filled voids 212, according to an embodiment. Elements depicted in FIG. 2 may be described above. For the sake of brevity, a further description of these elements is omitted.

As depicted in FIG. 2, a wellbore 210 in a subterranean formation 230 may have voids 212 near the bottom of the wellbore. Responsive to the container body 110 breaking, sections 220 of the expandable materials 120 may expand to be positioned within the voids 212. Furthermore, while a drill bit breaks container body 110, the drill bit may also break the expandable materials 120 into smaller parts, and push the fragments 221 of expandable materials 120 into the voids 212 while the drill bit travels down well. This may allow different sections of the expandable materials 120 to be positioned into different voids 212 within the wellbore. This may also allow fragments 221 to be detached from a body of the expandable materials 120 to be positioned within voids 212 in a location passed the circumference of the wellbore 210. Additionally, the fragments 221 may be positioned within voids 212 to seal the voids while sections 220 of the expandable material 120 still attached to the body of expandable material 120 may simultaneously fill the same void 212.

Figure 3:
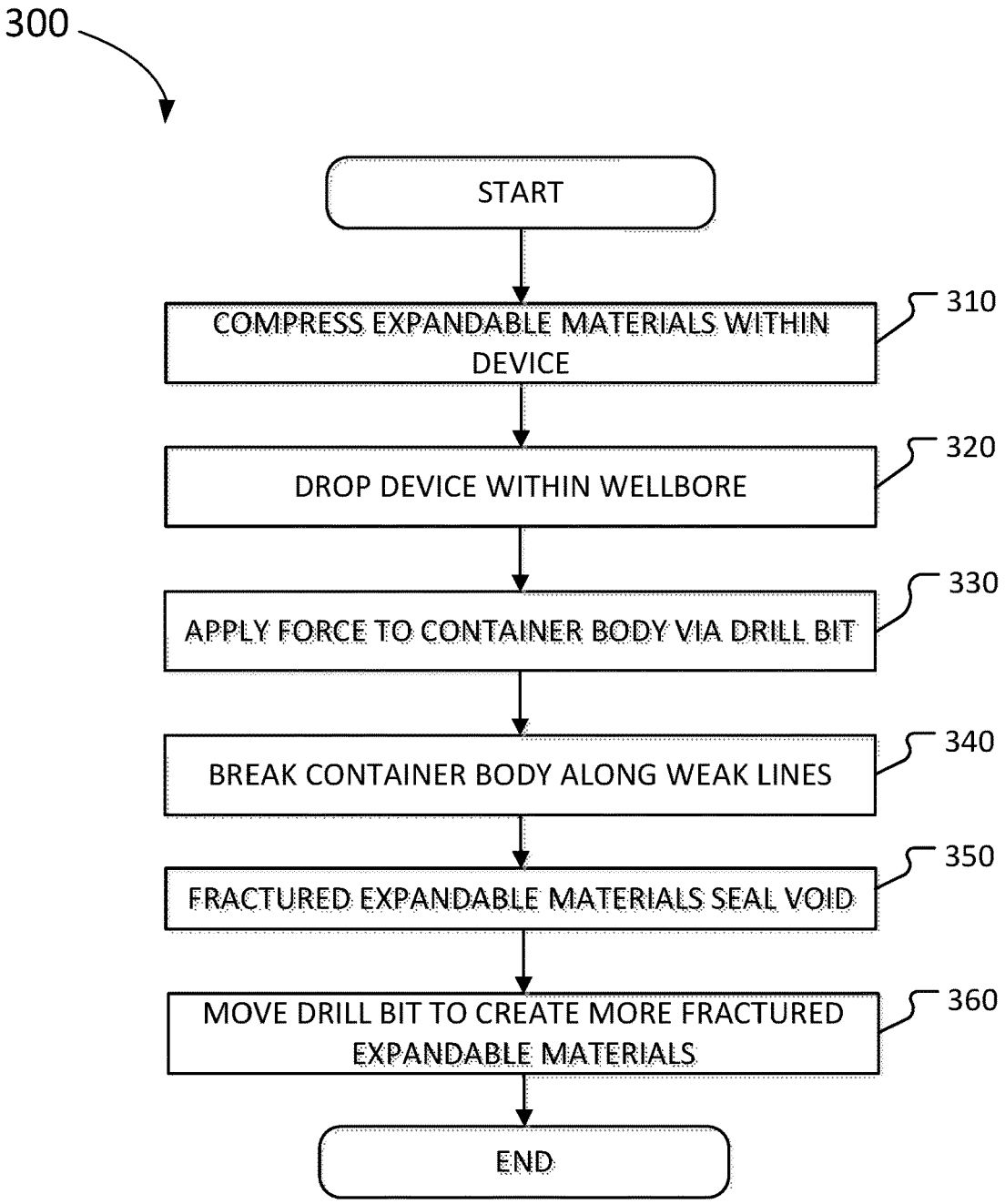
FIG. 3 depicts a method for utilizing a device to fill voids, according to an embodiment.

FIG. 3 depicts a method 300 for utilizing a device to fill voids, according to an embodiment. The operations of method 300 presented below are intended to be illustrative. In some embodiments, method 300 may be accomplished with one or more additional operations not described, and/or without one or more of the operations discussed. Additionally, the order in which the operations of method 300 are illustrated in FIG. 3 and described below is not intended to be limiting.

At operation 310, expandable materials may be compressed within a hollow chamber within a container body. The expandable materials may be secured within the container body by closing a lid on an upper surface of the container body.

At operation 320, the device with the expandable materials may be dropped into a wellbore. The device may sink to the bottom of the wellbore due to the weight of the device and/or the device may be pushed down well by a drill bit.

At operation 330, the drill bit may apply force against the container body by the weight of the drill pipe or rotation.

At operation 340, the container body may break along weak lines, and portions of the expandable materials may be fractured by the drill bit.

At operation 350, the fractured expandable materials may travel into a void within the wellbore and expand. This may seal the void.

At operation 360, the drill bit may continue rotating and fracturing and separating the container body and expandable materials into multiple fragments. The fragments of the expandable materials and the container body may enter voids, and seal the voids.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A device for sealing a wellbore, the device comprising:

a container body with a hollow inner chamber, wherein the container body is breakable;

sidewalls of the container body extending from a proximal end of the container body;

diagonal grooves positioned on an outer circumference of the sidewalls being configured to reduce the thickness of the sidewalls along the diagonal grooves, wherein the container body is configured to break along the diagonal grooves, wherein a first set of diagonal grooves are angled upward and a second set of diagonal grooves are angled downward;

equalizing ports positioned between the diagonal grooves, the equalizing ports extending from the outer circumference of the sidewalls into the hollow chamber, the equalizing ports being configured to allow drilling fluid to enter the hollow inner chamber, the equalizing ports being vertically aligned with intersections of the diagonal grooves positioned on the outer circumference of the sidewalls; and a body of an expandable material configured to be housed within the hollow inner chamber, the expandable material being configured to be compressed within the container body, in a first state before being positioned within the wellbore to have a smaller diameter than that of the wellbore and the container body and the body of the expandable material is expanded in a second state responsive to the container body breaking for the body of the expandable material to have a larger diameter than that of the wellbore and the container body and expand into different voids within the wellbore, wherein the expandable material is in the first state when housed within the hollow inner chamber, wherein fragments of the body of expandable material are configured to detach from the body of the expandable material and be positioned within voids in a location passed the circumference of the wellbore in the second state responsive to the container body breaking and the container body no longer applying a compressive force against the expandable material, wherein the expandable material is a compressible and elastic reticulated foam.

2. The device of claim 1, wherein the device further comprises a weighted end comprised of a different material than the container body and the expandable material positioned on the distal end of the container body.

3. The device of claim 1, wherein a diameter of the container body is smaller than the wellbore.

4. A method for sealing a wellbore, the method comprising:

compressing a body of an expandable material within a hollow inner chamber of a container body in a first state to have a smaller diameter than that of the wellbore and the container body, the first state occurring before the container body is positioned within the wellbore, wherein the container body includes sidewalls extending from a proximal end of the container body to a distal end of the container body;

positioning the container body within the wellbore;

flowing drilling fluid through equalizing ports positioned between diagonal grooves, the equalizing ports extending from the outer circumference of the sidewalls into the hollow chamber and mixing the drilling fluid with the expandable material the equalizing ports being vertically aligned with intersections of the diagonal grooves positioned on the outer circumference of the sidewalls, wherein a first set of diagonal grooves are angled upward and a second set of diagonal grooves are angled downward;

breaking the container body along diagonal grooves positioned on an outer circumference of the sidewalls, the diagonal grooves reducing the thickness of the sidewalls along the diagonal grooves, wherein equalizing ports are positioned between the diagonal grooves while in the first state, the equalizing ports extending from the outer circumference of the sidewalls into the hollow chamber of the container body;

expanding the body of the expandable material to occupy more volume, in a second state to have a larger diameter than that of the wellbore and the container body and expand into different voids within the wellbore, responsive to the container body breaking and the container body no longer applying a compressive force against the body of the expandable material;

detaching fragments of the expandable material from the body of the expandable material; and positioning the fragments of the expandable material that are detached from the body of the expandable material within voids in a location passed the circumference of the wellbore responsive to the container body breaking, wherein the body of the expandable material and the fragments are positioned within the voids are in the second state wherein the expandable material is a compressible and elastic reticulated foam.

5. The method of claim 4, further comprising:

positioning a weighted end on the distal end of the container body, the weighted end being comprised of a different material than the container body and the expandable material.

6. The method of claim 4, wherein a diameter of the container body is smaller than the wellbore.

* * * * *